US007861841B2

(12) United States Patent
Nagase et al.

(10) Patent No.: US 7,861,841 B2
(45) Date of Patent: Jan. 4, 2011

(54) COIN DEPOSITING AND DISPENSING MACHINE

(75) Inventors: Atsushi Nagase, Himeji (JP); Keita Toyama, Himeji (JP); Keita Ito, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 0 days.

(21) Appl. No.: 12/211,173

(22) Filed: Sep. 16, 2008

(65) Prior Publication Data

US 2009/0071793 A1 Mar. 19, 2009

(30) Foreign Application Priority Data

Sep. 19, 2007 (JP) ..... 2007-242644
Sep. 19, 2007 (JP) ..... 2007-242645

(51) Int. Cl.
*G07F 9/02* (2006.01)

(52) U.S. Cl. ..... 194/200

(58) Field of Classification Search ..... 194/200, 194/344, 350

See application file for complete search history.

(56) References Cited

U.S. PATENT DOCUMENTS 5,219,059 A * 6/1993 Furuya et al. ..... 194/200
5,746,299 A 5/1998 Molbak et al.
5,957,262 A 9/1999 Molbak et al.
5,989,118 A 11/1999 Chiba et al.
7,470,174 B2 12/2008 Umeda et al.
2002/0170801 A1* 11/2002 Martin ..... 194/200
2003/0051970 A1* 3/2003 Furneaux et al. ..... 194/200
2007/0087675 A1 4/2007 Umeda et al.

FOREIGN PATENT DOCUMENTS

EP 0477722 A2 4/1992
EP 0831429 A2 3/1998
EP 1777661 A1 4/2007
JP 2001-043449 A 2/2001

* cited by examiner

*Primary Examiner*—Stefanos Karmis
*Assistant Examiner*—Mark Beauchaine
(74) *Attorney, Agent, or Firm*—Renner, Kenner, Greive, Bobak, Taylor & Weber

(57) ABSTRACT

A coin depositing and dispensing machine automatically returning coins remaining on a passage in case an error-stop during depositing operation. The coins on the passage are transported by the transporting unit for depositing in a reverse transporting direction reverse to the depositing and transporting direction, one coin in a sorting passage is transported to the upstream side from a rejecting portion. Then, the coins on the passage are transported by the transporting unit for depositing in the depositing and transporting direction, and eliminated by the rejecting portion. While the coins on the passage are transported by the transporting unit for depositing alternately in the depositing and transporting direction and the reverse transporting direction, the coins in the sorting passage are eliminated by the rejecting portion one by one.

4 Claims, 8 Drawing Sheets

(a)

(b)

COIN DEPOSITING AND DISPENSING MACHINE

INCORPORATION BY REFERENCE

The present invention claims priority under 35 U.S.C. §119 to Japanese Patent Application Nos. 2007-242644 and 2007-242645 both filed on Sep. 19, 2007. The content of the application is incorporated herein by reference in their entirety.

FIELD OF THE INVENTION

The present invention relates to a coin depositing and dispensing machine for depositing and dispensing coins.

BACKGROUND OF THE INVENTION

Conventionally, a coin depositing and dispensing machine enabling automatic depositing and dispensing of coins by control signals transmitted from a POS cash register, an electronic cash register, a teller management machine or other cashier equipment, has been used for accurately and promptly delivering cash between operators and customers at, for example, a cash register in a shop or a teller in a financial institution.

For example, in a coin depositing and dispensing machine disclosed in Japanese Laid-Open Patent Publication No. 2001-43449, in a depositing process, coins put into a coin input port are fed to an identifying passage one by one and identified by an identifying portion, rejected coins are eliminated by a rejecting portion, and coins identified as normal coins are transported to a sorting passage, sorted for each denomination, and accommodated in denomination-specific accommodating and ejecting portions. Additionally, in a dispensing process, coins ejected from each accommodating and ejecting portion of denomination of coins to be dispensed are accepted by transporting unit for dispensing and dispensed into a coin dispensing port.

However, in the case where, during the depositing process, a sorting error or the like is detected such that coins are not sorted at denomination-specific positions, where the coins are to be sorted, in the sorting passage and pass through the positions, the depositing process is subjected to an error-stop. In the error-stop, transport of coins on the passage is immediately stopped, and thus the coins remain on the passage.

In the case of the error-stop, an operator is required to open a machine body and take off all the coins remaining on the passage one by one by hand, and error-stop removal is troublesome. Balance inconsistency is caused by a removal mistake such that the operator drops the coins outward or into the accommodating and ejecting portion when taking off the coins by hand.

The present invention was made in view of the above problem, and aims at providing a coin depositing and dispensing machine capable of, in the case where the error-stop occurs during depositing operation, eliminating the need for manually taking off the coins remaining on the passage, easing the error-stop removal, and preventing a removal mistake that occurs when the error-stop is manually removed from causing the balance inconsistency.

SUMMARY OF THE INVENTION

A coin depositing and dispensing machine according to the present invention includes: a feeding mechanism for coins put into a coin input port one by one; an identifying passage having an identifying portion for identifying the coins fed from the feeding mechanism; an eliminating passage which is disposed continuously to the identifying passage and has a rejecting portion for discharging coins identified as rejected coins by the identifying portion; a sorting passage which is disposed continuously to the eliminating passage and sorts the coins; transporting unit for depositing capable of transporting the coins in a depositing and transporting direction of transporting the coins through the identifying passage, eliminating passage and sorting passage in this order, and in a reverse transporting direction reverse to the depositing and transporting direction; denomination-specific accommodating and ejecting portions which are disposed under the sorting passage, accommodate the coins sorted for each denomination by the sorting passage therein and can eject the accommodated coins; and transporting unit for dispensing for transporting the coins ejected from the accommodating and ejecting portions into a coin dispensing port, and further includes control unit for executing automatic restoration control for returning coins remaining in the sorting passage into the coin dispensing port by the transporting unit for depositing, rejecting portion and transporting unit for dispensing in the case where an error-stop occurs during depositing operation. Since, as described above, the automatic restoration control allows the coins remaining in the sorting passage to be returned into the coin dispensing port by the transporting unit for depositing, rejecting portion and transporting unit for dispensing in the case where the error-stop occurs during the depositing operation, coins remaining on the passage are not required to be manually taken off, the error-stop can be easily removed, and a removal mistake that occurs when the error-stop is manually removed can be prevented from causing balance inconsistency.

Additionally, the coin depositing and dispensing machine of the present invention includes resetting unit for instructing reset of the error-stop, and the control unit executes the automatic restoration control by the reset of the error-stop by the resetting unit. Since the automatic restoration control can be executed by instructing reset of error-stop by the resetting unit, automatic restoration can be executed by simple operation.

Additionally, in the coin depositing and dispensing machine of the present invention, the control unit, after the automatic restoration control, handles the coins returned into the coin dispensing port as rejected coins and makes the depositing operation automatically restart. As described above, after the automatic restoration control, the depositing operation can be automatically restarted, the coins returned into the coin dispensing port are handled as rejected coins, and the balance inconsistency can be prevented.

Additionally, in the coin depositing and dispensing machine of the present invention, the rejecting portion can discharge the coins transported by the transporting unit for depositing in the depositing and transporting direction and the reverse transporting direction, and the control unit makes the rejecting portion eliminate the coins only by reverse rotation of the transporting unit for depositing in the reverse transporting direction at the time of the automatic restoration control. As described above, at the time of the automatic restoration control, the coins remaining in the sorting passage can be eliminated only by the reverse rotation of the transporting unit for depositing in the reverse transporting direction, and the error-stop can be removed in a short time.

DETAILED DESCRIPTION OF THE PREFERRED EMBODIMENT

Hereinafter, an embodiment of the present invention will be described with reference to the drawings.

Figure 3:
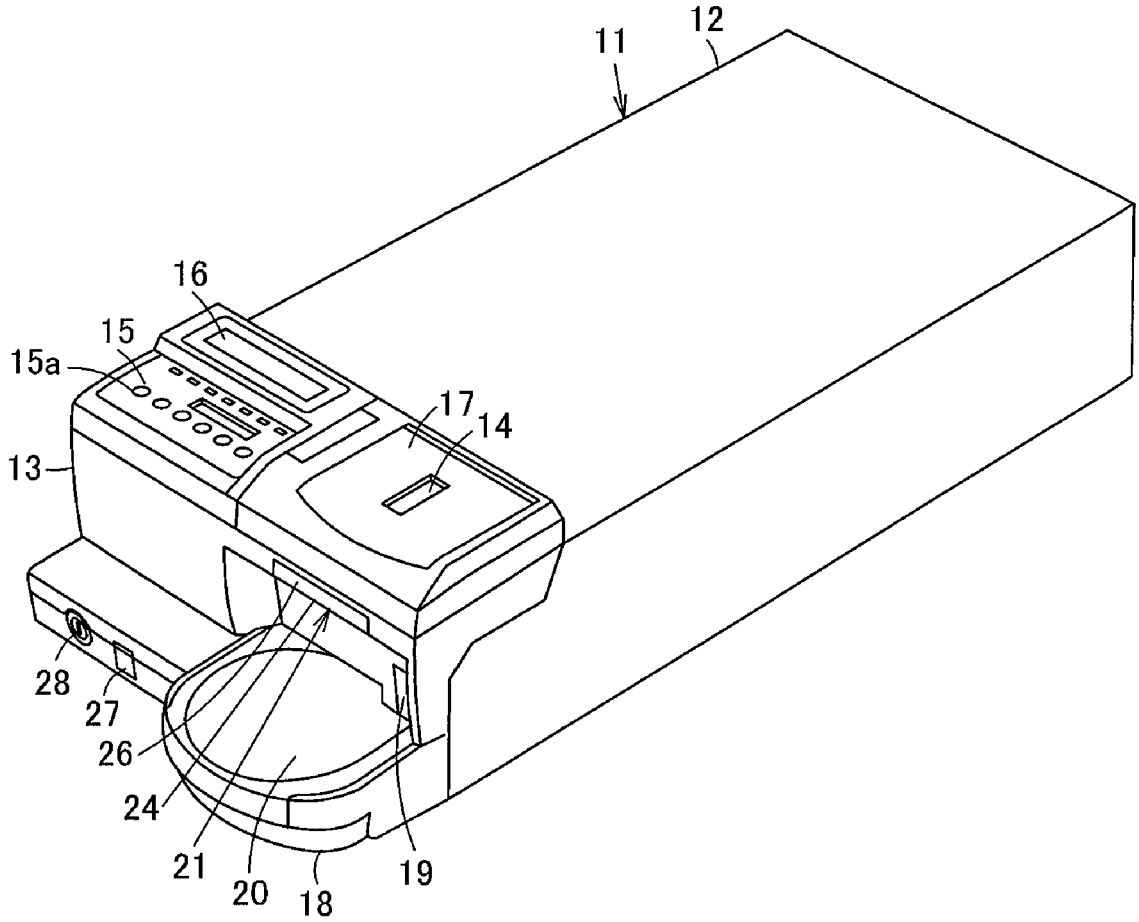
FIG. 3 is a perspective view of the coin depositing and dispensing machine.

FIG. 3 is a perspective view of a coin depositing and dispensing machine. The coin depositing and dispensing machine is a coin depositing and dispensing machine which communicates with a POS cash register and enables depositing and dispensing of coins at, for example, a cash register in a shop.

A coin depositing and dispensing machine 11 includes a machine body 12 having an opened front face and a body unit 13 capable of being pulled out from the front face of the machine body 12. The dimension of the front face of the body unit 13 in a machine body width direction is formed so as to be approximately half of that of the POS cash register, and the coin depositing and dispensing machine 11 can be used in combination with, for example, a banknote depositing and dispensing machine having a width the same as that thereof.

A coin input port 14, into which coins are put, is formed on the right side, which is one side in the machine body width direction, of an upper face of the front of the body unit 13 projecting from the machine body 12. An operating portion 15 and a display portion 16 are disposed on the left side which is the other side in the machine body width direction, the operating portion 15 having operating and setting buttons including a reset button 15*a* as resetting unit for instructing reset at the time of error-stop, the display portion 16 including a liquid crystal display for displaying each item relating to operation, setting and the like, and an LED display for displaying the denomination-specific accommodated coin quantity. The coin input port 14 is made in an openable/closeable cover 17.

A dispensing tray 18 is projected on a lower part on the right side of the front face of the body unit 13, and a coin dispensing port 20, into which coins to be dispensed from the machine are released through a coin release port 19, is formed on an upper face of the dispensing tray 18. A full detecting sensor (not shown) for optically detecting a full state, where the coin dispensing port 20 is filled with the dispensed coins, is disposed on the dispensing tray 18.

Figure 4:
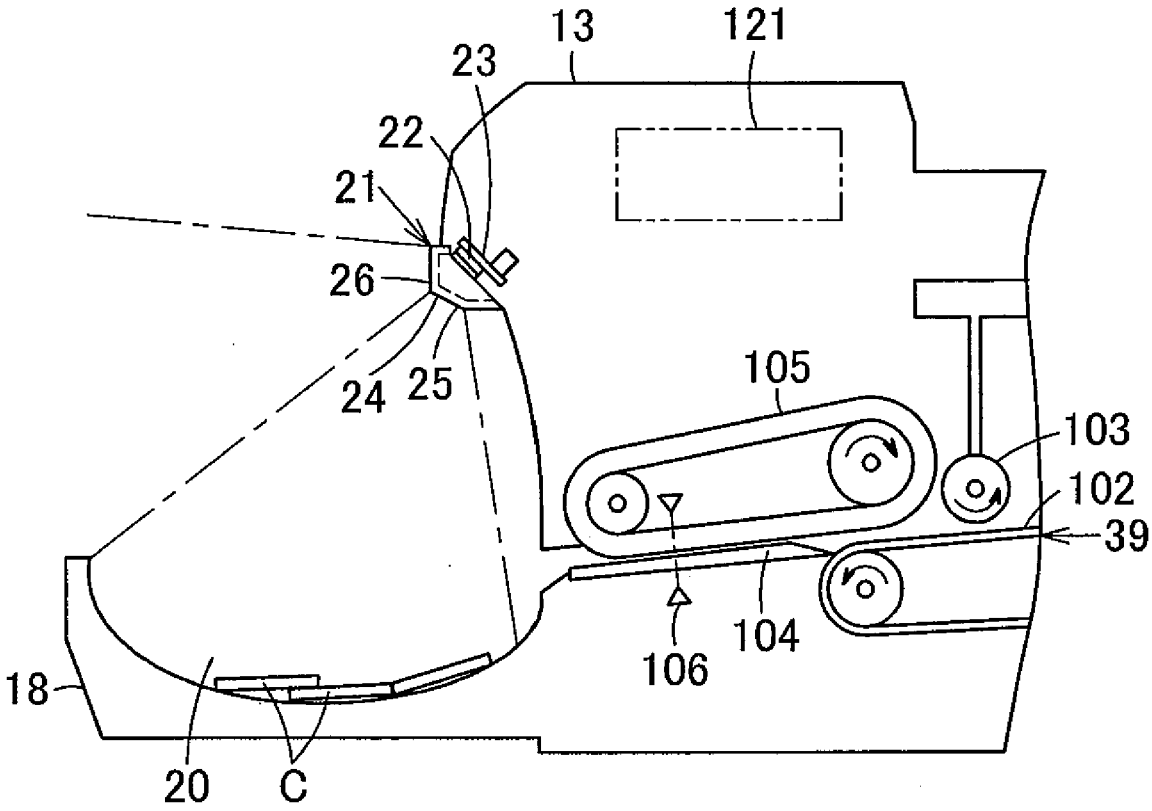
FIG. 4 is a cross sectional view of the vicinity of a coin dispensing port of the coin depositing and dispensing machine.

Light emitting unit 21 is disposed on the front face of the body unit 13 located above the coin dispensing port 20, the light emitting unit 21 emitting light in a different light emission form for each handling type of coins such as a coin to be paid, rejected coin and error return coin dispensed into the coin dispensing port 20. The light emitting unit 21, as shown in FIG. 4, includes an LED 22 as a light emitting portion capable of emitting light of at least two different colors, and a substrate 23, on which the LED 22 is mounted, is obliquely provided so that the LED 22 faces the coin dispensing port 20. The light emitting unit 21 is covered with a lens 24. The lens 24 includes: a coin dispensing port irradiating lens portion 25, which is obliquely formed so as to face the coin dispensing port 20 and irradiates light emitted from the LED 22 to the whole coin dispensing port 20 and coins (indicated by a symbol C in the figures, the symbol will be omitted hereinafter) themselves dispensed into the coin dispensing port 20; and a forward irradiating lens portion 26 which is formed on the front face so as to face forward and irradiates the light emitted from the LED 22 forward.

Additionally, as shown in FIG. 3, a power source switch 27 of the coin depositing and dispensing machine 11 and a key 28 are disposed on the left side of the front face of the body unit 13, the key 28 for locking the body unit 13 with the unit 13 inserted in the machine body 12.

Figure 1:
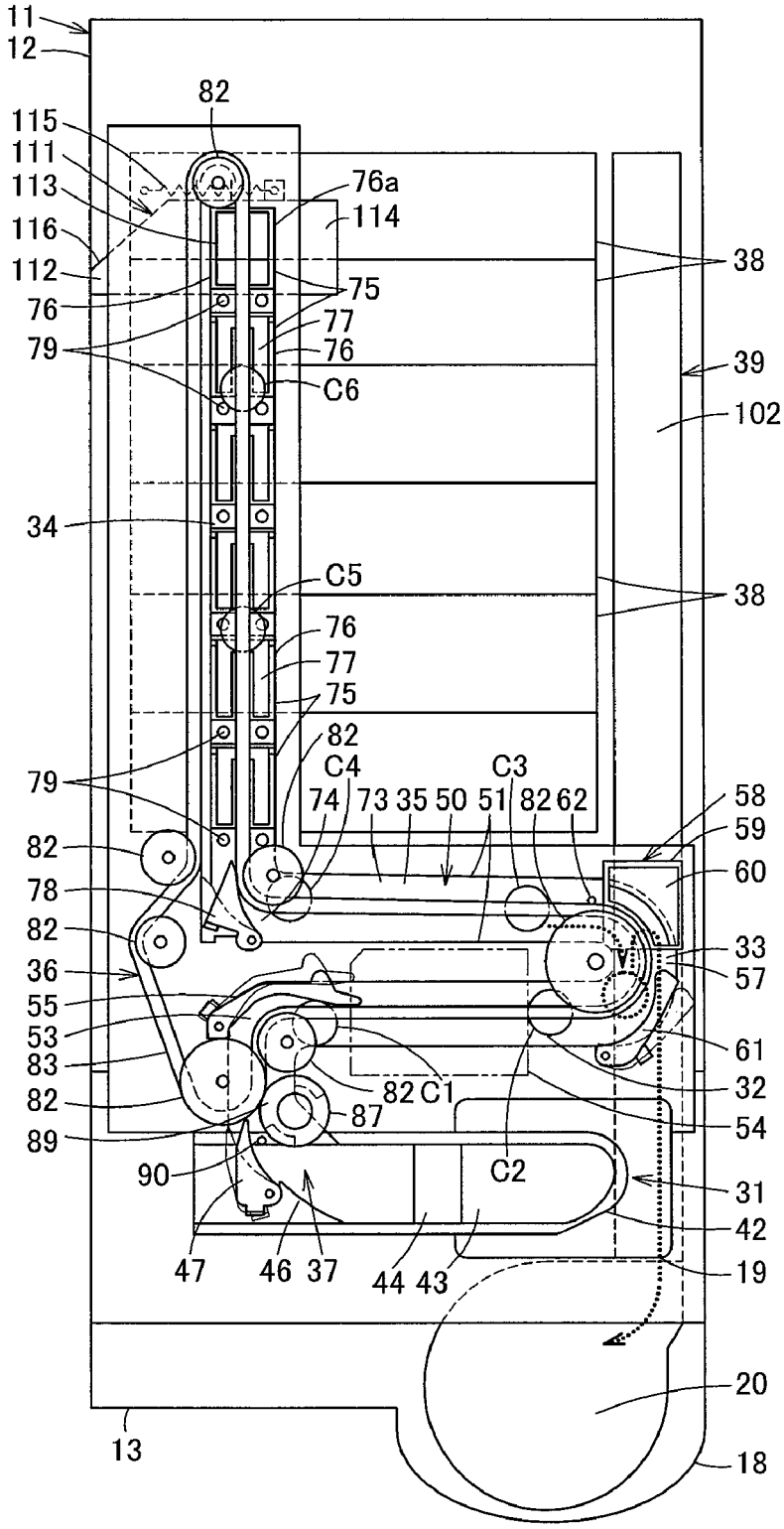
FIG. 1 is a plan view of an internal structure of a coin depositing and dispensing machine according to an embodiment of the present invention.

FIG. 1 is a plan view showing an internal structure of the coin depositing and dispensing machine. The coin depositing and dispensing machine 11 includes: a feeding mechanism 31 disposed along the front of the machine body along the machine body width direction; a coin passage 35 having an identifying passage 32 disposed continuously to the feeding mechanism 31 in the machine body width direction, an eliminating passage 33 disposed continuously to the identifying passage 32 in a machine body depth direction, and a sorting passage 34 disposed continuously to the eliminating passage 33 in the machine body depth direction; transporting unit for depositing 36 for transporting coins in the coin passage 35; delivering unit 37 for delivering coins fed from the feeding mechanism 31 to the transporting unit for depositing 36 one by one; denomination-specific accommodating and ejecting portions 38 as denomination-specific accommodating portions juxtaposed under the sorting passage 34 in the machine body depth direction; and transporting unit for dispensing 39 disposed adjacently to the right sides of the accommodating and ejecting portions 38, and in a longitudinal direction along a right side face of the machine body.

The feeding mechanism 31 has a receiving and accommodating portion 42 under the coin input port 14, the receiving and accommodating portion 42 for receiving and accommodating coins put into the coin input port 14 with the coins not aligned, and a feeding belt 43 constituting a bottom of the receiving and accommodating portion 42 is disposed along the machine body width direction. The feeding belt 43 is an endless flat belt, transports the coins from the right side to left side of the machine body in a coin feeding direction, and is suspended by a plurality of rollers (not shown) so that an upward tilting region is formed at the upstream side in the feeding direction toward the downstream side in the feeding direction and a horizontal region is formed at the downstream side in the feeding direction. The width of a passage on the feeding belt 43 is regulated so as to be larger than the diameter of the largest coin to be processed and smaller than the total diameters of the two smallest coins to be processed.

A reverse rotating roller 44 is disposed across a gap, through which only one coin can pass in its thickness direction, from the upper side of the upward tilting region of the feeding belt 43. The reverse rotating roller 44 rotates in a direction reversely to the coin feeding direction of the feeding belt 43, and aligns and feeds non-aligned coins, which are to be fed by rotation of the feeding belt 43 in the coin feeding direction, on the feeding belt 43 by one layer and one line.

Figure 5:
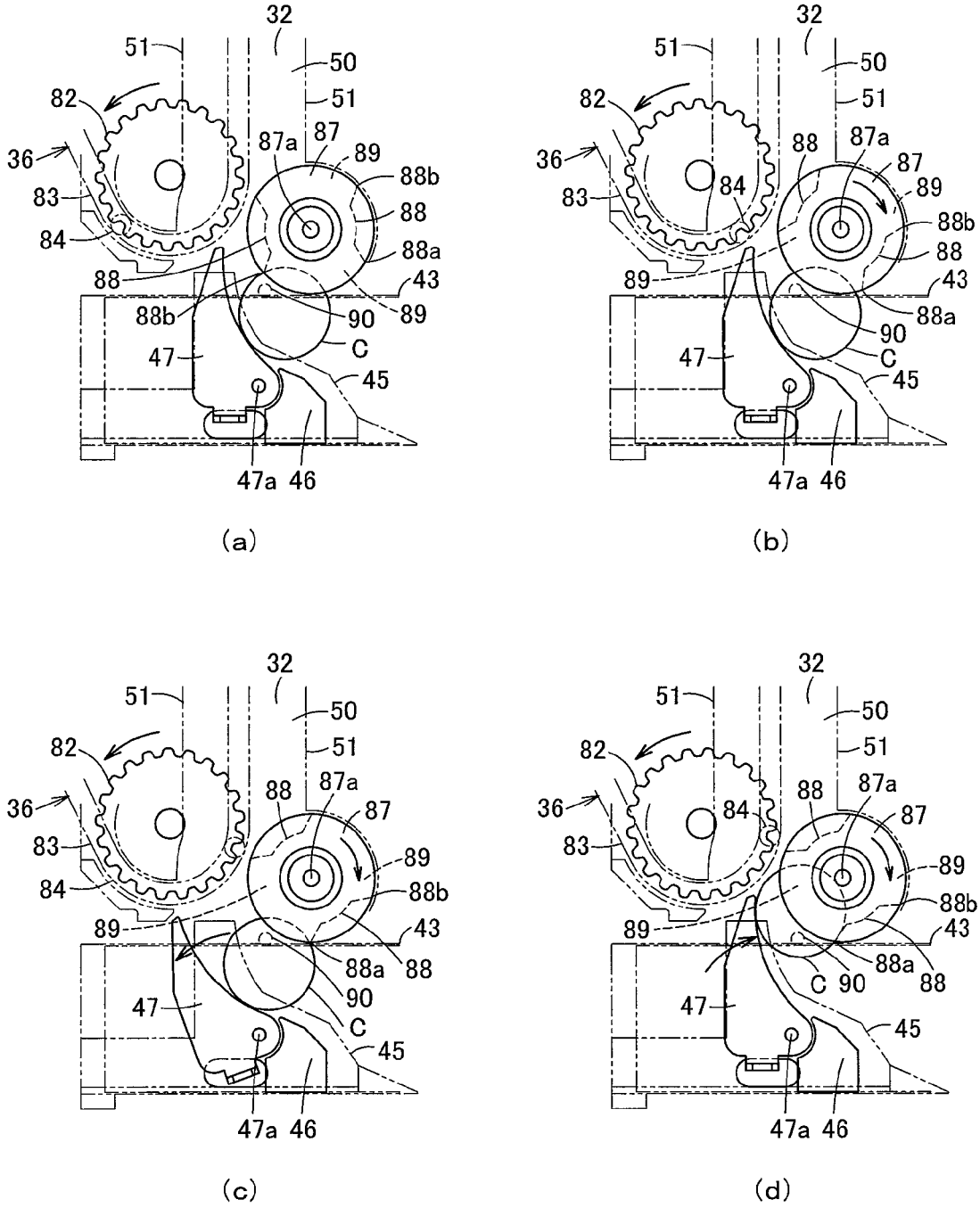
FIGS. 5(*a*) to 5(*d*) each is a plan view showing operation of delivering unit of the coin depositing and dispensing machine.

As shown in FIG. 5, a regulating member 45 is disposed across a gap, in which only one coin can enter between the member 45 and the feeding belt 43 in the thickness direction, from the upper side of the horizontal region at the downstream side of the feeding belt 43 in the feeding direction. A guide portion 46 is disposed on the lower side of the regulating member 45, the guide portion 46 with which the circumference of the coin on the feeding belt 43 comes into contact and which guides the coin to the starting end side of the identifying passage 32, and a part, which faces a feeding position to the starting end side of the identifying passage 32, of the guide portion 46 is constituted by a pulling-over lever 47 for pulling coins to be fed to the identifying passage 32 over to the inner side of the passage. The pulling-over lever 47 constitutes a part of the delivering unit 37, can rock about a shaft 47*a* as a fulcrum in a passage inner and outer direction, and is urged by a spring (not shown) as biasing unit so as to rock to the inner side of the passage.

Additionally, as shown in FIG. 1, the coin passage 35 running through the identifying passage 32, eliminating passage 33 and the sorting passage 34 has a passage face 50 constituted by a horizontal face with which one face of the coin comes into contact, and passage side guides 51 for guiding the circumference of the coin at both sides of the passage face 50. A passage width that is a facing width of both the passage side guides 51 is formed so as to be larger than the diameter of the largest coin to be processed and smaller than the total diameters of the two smallest coins to be processed.

The identifying passage 32 is disposed, inside relative to the feeding mechanism 31, in parallel with the feeding belt 43 of the feeding mechanism 31 via a first turn passage portion 53 turning in a right direction from the starting end connected to the feeding position of the feeding mechanism 31. An identifying portion 54 for detecting the material quality, diameter and the like of a coin and identifying a denomination is disposed at the identifying passage 32. A pulling-over lever 55 for pulling coins over to one side in a passage width direction is rockably pivotally supported on the first turn passage portion 53 and urged so as to rock to the inner side of the passage, in order to make the identifying portion 54 stably identify coins.

Additionally, the eliminating passage 33 is formed in a second turn passage portion 57 continuing to the identifying passage 32 and turning in a left direction of the machine body, and a rejecting portion 58 is disposed aside of the eliminating passage 33, the rejecting portion 58 for eliminating coins rejected as a result of identification of the identifying portion 54. A rejection hole 59 is formed in the rejecting portion 58, the rejection hole 59 having a diameter that the coin can be diverted throughout a portion from the passage face 50 to the passage side guide 51 on the outer circumferential side of the second turn passage portion 57, and a rejecting gate 60 is arranged over the rejection hole 59, the rejecting gate 60 serving as a part from the passage face 50 to the passage side guide 51 on the outer circumferential side of the second turn passage portion 57. The rejecting gate 60 rocks upward from the passage about its machine body back side as a fulcrum, can open/close between an open position for eliminating the rejected coins, which are transported from the identifying passage 32 side, through the rejection hole 59, and a close position for closing the rejection hole 59 and permitting passage of the coins from the identifying passage 32 to the sorting passage 34, and is open/close-driven by electric driving unit such as a solenoid or motor (not shown).

A pulling-over lever 61 for pulling coins over to one side in a passage width direction is pivotally supported on the second turn passage portion 57 and urged to rock to the inside of the passage, so that the rejected coins are reliably eliminated by the rejecting portion 58.

A coin detecting sensor 62 for detecting passage of coins is disposed at the downstream side from the rejecting portion 58 in a coin depositing and transporting direction (identifying passage 32, eliminating passage 33 and sorting passage 34 in this order).

Figure 2:
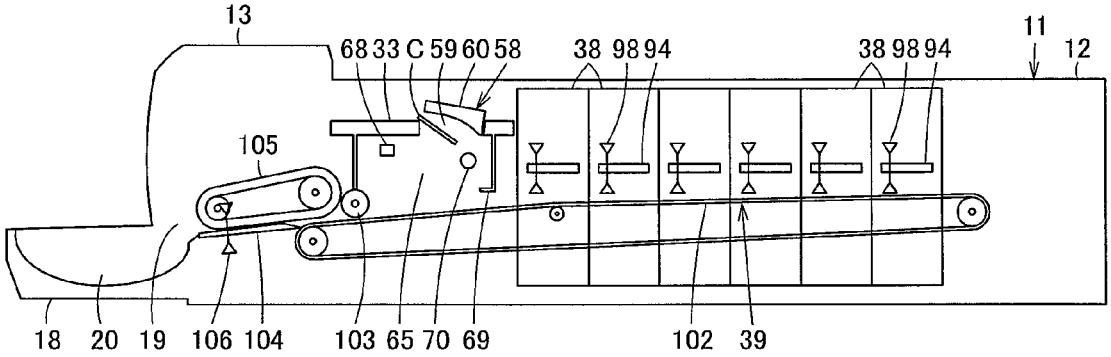
FIG. 2 shows the internal structure of the coin depositing and dispensing machine, FIG. 2(*a*) is a side view of the machine to which a rejection box is not attached, and FIG. 2(*b*) is a side view of the machine to which the rejection box is attached.
Figure 2:
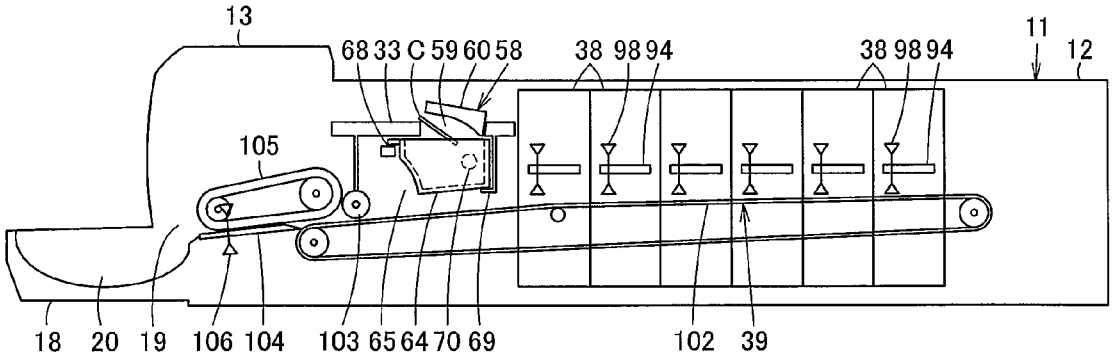
Figure 6:
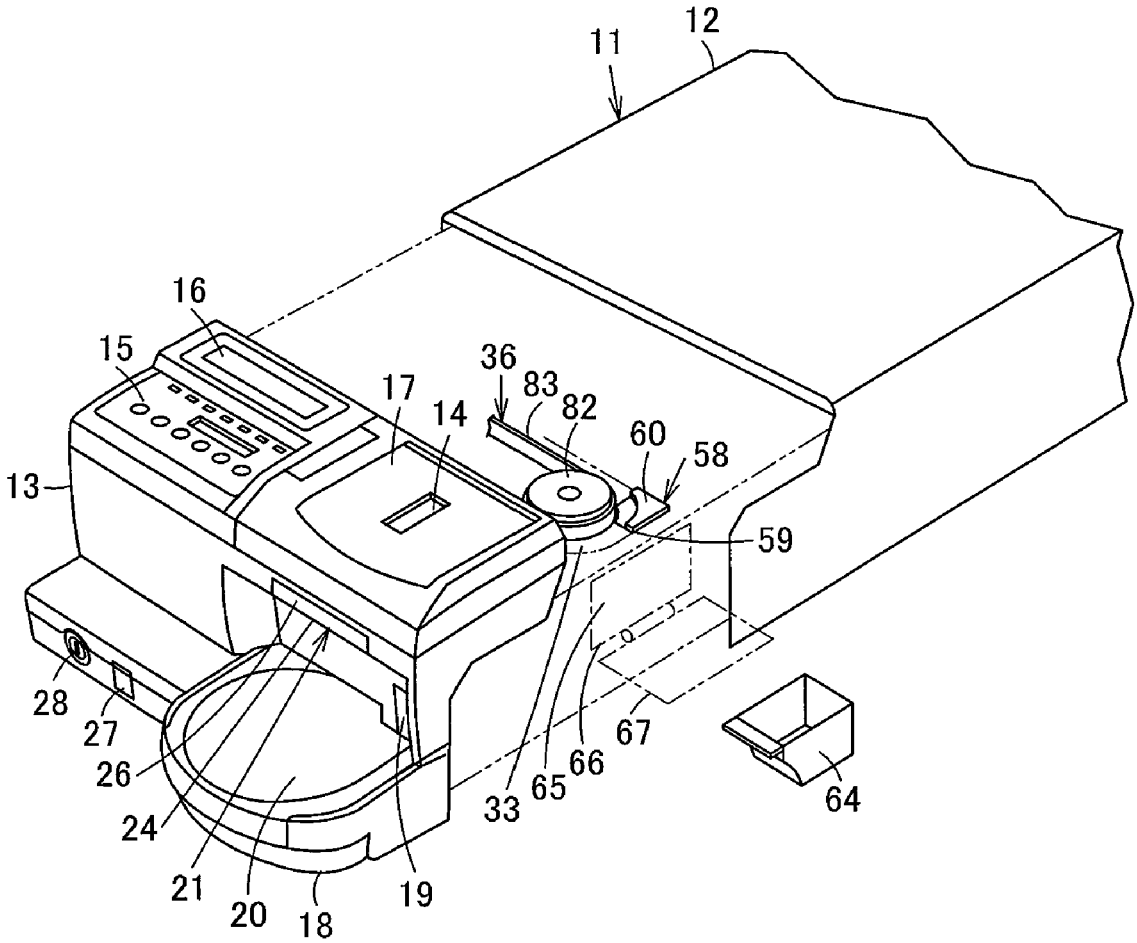
FIG. 6 is a perspective view for explaining attachment/detachment operation of the rejection box of the coin depositing and dispensing machine.

Additionally, as shown in FIGS. 2 and 6, a rejection box attaching portion 65, to/from which a rejection box 64 can be attached/detached, is formed under the rejection hole 59 of the rejecting portion 58.

The rejection box 64 is formed in the shape of a box having an opened upper face, and can be attached/detached through an attachment/detachment port 66, which is made in a side face of the rejection box attaching portion 65, with the body unit 13 pulled forward from the machine body 12. The attachment/detachment port 66 can be opened/closed by a cover 67.

The rejection box attaching portion 65 has a front side supporting portion 68 for supporting the front end edge of the rejection box 64, and a rear side supporting portion 69 for supporting a lower face at the rear of the rejection box 64, a space between the front side supporting portion 68 and rear side supporting portion 69 is opened downward, and the transporting unit for dispensing 39 is disposed under the supporting portions so as to face them. That is, the transporting unit for dispensing 39 is disposed under the rejection hole 59 of the rejecting portion 58, and the rejection box 64 is arranged attachably/detachably into/from a space between the rejection hole 59 of the rejecting portion 58 and the transporting unit for dispensing 39.

As shown in FIG. 2(*a*), the transporting unit for dispensing 39 receives the rejected coins eliminated from the rejecting portion 58 to dispense them into the coin dispensing port 20 by not attaching the rejection box 64 to the rejection box attaching portion 65. Additionally, as shown in FIG. 2(*b*), the rejected coins eliminated from the rejecting portion 58 are accommodated in the rejection box 64 by attaching the rejection box 64 to the rejection box attaching portion 65.

Rejection box detecting unit 70 for detecting whether the rejection box 64 is attached is disposed in the rejection box attaching portion 65.

Additionally, as shown in FIG. 1, the sorting passage 34 is disposed so as to pass through a left side region above the accommodating and ejecting portions 38 in the machine body depth direction via a connecting passage portion 73 leading from the eliminating passage 33 to the left side of the machine body and a direction changing passage portion 74 leading from the connecting passage portion 73 to the rear side of the machine body. Sorting portions 75 are disposed, the sorting portions 75 sorting coins by denomination at denomination-specific sorting positions, that respectively correspond to portions above the denomination-specific accommodating and ejecting portions 38, and making each accommodating and ejecting portion 38 accommodate the sorted coins. Denominations to be sorted by the sorting portions 75 are, for example, 500 yen, 100 yen, 50 yen, 10 yen, 5 yen and 1 yen in this order from the upstream side in the depositing and transporting direction. In each sorting portion 75, a sorting hole 76 for dropping the coins is formed in the passage face 50, and a sorting gate 77 is disposed at each sorting hole 76 except for the sorting hole 76 located at the most downstream side in the depositing and transporting direction. Each sorting gate 77 rocks, upward from the passage, about its downstream side in the depositing and transporting direction as a fulcrum, can be opened/closed between an open position for dropping the coins, which are transported from the upstream side of the sorting passage 34 in the depositing and transporting direction, into the sorting hole 76, and a close position for closing the sorting hole 76 and permitting passage of the coins to the downstream side of the sorting passage 34 in the depositing and transporting direction, and open/close-driven by electric driving unit such as a solenoid or motor (not shown). No sorting gate is disposed to the sorting hole 76 located at the most downstream side in the depositing and transporting direction and the hole is in an open state so that all the coins that have been transported will drop. Hereinafter, the sorting hole 76 located at the most downstream side in the depositing and transporting direction will be referred to as an open sorting hole 76*a*.

A pulling-over lever 78 for pulling coins over to one side in a passage width direction is pivotally supported on the direction changing passage portion 74 and urged so as to rock to the inner side of the passage, so that the coins are reliably sorted by each sorting portion 75.

A coin detecting sensor 79 for detecting coins to be transported is disposed at the upstream side of each sorting portion 75 of the sorting passage 34 in the depositing and transporting direction so that an open/close timing of the sorting gate 77 is set and sorting of coins to each accommodating and ejecting portion 38 is checked.

Additionally, a transporting belt 83 as a transporting body is stretched in the transporting unit for depositing 36 so as to rotate while moving along center regions of the identifying passage 32, eliminating passage 33 and sorting passage 34 in the passage width direction by a plurality of pulleys 82 each as a rotation body pivotally supported on a vertical shaft so as to be horizontally rotatable. As the transporting belt 83, for example, a timing belt having a plurality of teeth on its inner circumference is used. In this case, as the pulley 82, a timing pulley having a plurality of teeth on its circumferential face is used. The distance of an interval between the transporting belt 83 supported by the plurality of pulleys 82 and the passage face 50 is kept larger than the thickness of a coin having a maximum thickness to be processed.

Projected portions 84 (see FIG. 5), which project downward and push and transport the coins in the passage one by one, are provided on the transporting belt 83 at a predetermined interval so that the coins can be separated and transported one by one. The distance of an interval between the projected portion 84 and the passage face 50 is kept smaller than the thickness of a coin having a minimum thickness to be processed.

The transporting unit for depositing 36 can transport the coins in the depositing and transporting direction (through the identifying passage 32, eliminating passage 33 and sorting passage 34 in this order) and in a reverse transporting direction reverse to the depositing and transporting direction.

Additionally, as shown in FIG. 5, the delivering unit 37 is disposed at the starting end, from which the coins fed from the feeding mechanism 31 are received into the identifying passage 32, of the identifying passage 32, and has the pulling-over lever 47 for guiding the coins from the upper face of the feeding belt 43 to the identifying passage 32, and a circular cam 87 which is provided on the side opposite from the pulling-over lever 47 in the passage width direction and pivotally supported on a vertical shaft 87*a* so as to be horizontally rotatable. The cam 87 is rotationally driven by electric driving unit (not shown) such as a pulse motor in a coin delivering rotating direction (clockwise in FIG. 5) or reverse rotating direction (counterclockwise in FIG. 5).

A pair of projecting portions 88 is projected downward at symmetrical positions on the circumference of an edge of a lower face of the cam 87, and a pair of grooves 89 is formed between the projecting portions 88. An interval between the projecting portion 88 and the passage face 50 is formed at a dimension that the coin cannot enter. An interval between the groove 89 and the passage face 50 and the width of groove 89 between the projecting portions 88 are respectively formed at a dimension that one coin can enter.

An edge, which faces in the delivering rotating direction, of each projecting portions 88 is adapted to serve as a pressing portion 88*a* for pressing the circumference of the coin, which is fed from the feeding mechanism 31 and enters the groove 89, and delivering the coin to the projected portion 84 of the transporting belt 83. Additionally, an edge, which faces in a direction opposite from the delivering rotating direction, and outer circumferential face of each projecting portion 88 serve as a suppressing portion 88*b* for separating the succeeding coin from a coin to be delivered and keeps the succeeding coin until the next delivering timing.

A coin detecting sensor 90 for detecting the coins fed from the feeding mechanism 31 to the identifying passage 32 is disposed adjacently to the side of the feeding belt 43 of the feeding mechanism 31.

As shown in FIG. 5(*a*), a position, where the coin fed from the feeding mechanism 31 to the identifying passage 32 enters one of the grooves 89 of the cam 87 and stops in a state of coming into contact with one of the suppressing portions 88*b*, is set as a constant position of the cam 87, and the cam 87 rotates by 180° in the delivering rotating direction (clockwise in FIG. 5) at a timing that the coin can be delivered to the projected portion 84 in accordance with a position of the projected portion 84 of the transporting belt 83, and feeds the coin in one of the grooves 89 to the identifying passage 32. The succeeding coin fed from the feeding mechanism 31 enters the other groove 89 of the cam 87 and stops in a state of coming into contact with the other suppressing portion 88*b*, that is, stops at the next constant position, and stands by for the next delivering operation.

Here, when the cam 87 rotates as shown in FIG. 5(*b*) from the constant position shown in FIG. 5(*a*), the pressing portion 88*a* of the cam 87 comes into contact with the coin, the coin is clamped between the pressing portion 88*a* and the pulling-over lever 47, and the pulling-over lever 47 pressed by the cam 87 via the coin rocks outside of the passage against a biasing force, as shown in FIG. 5(*c*). However, the cam 87 is rotated by a specified angle from the constant position and then temporarily stopped for a predetermined time, and thus the coin is pushed into the groove 89 of the cam 87 by a biasing force of the pulling-over lever 47 as shown in FIG. 5(*d*). After the temporary stop for a predetermined time, the cam 87 rotates again to feed the coin pushed into the groove 89 to the identifying passage 32, and stops at the constant position after rotating by 180°.

The groove 89 of the cam 87 is formed so as to have a dimension that a coin having a maximum diameter can enter. Accordingly, in the case where coins to be processed contain 500 yen coins having the maximum diameter, 1 yen coins having a minimum diameter and the like, if a fixing guide is provided instead of the pulling-over lever 47 shown in FIG. 5(*c*), there is a possibility that two 1 yen coins each having the minimum diameter enter the groove 89 of the cam 87 and the cam 87 locks the 1 yen coins by biting them between itself and the fixing guide. On the other hand, if the pulling-over lever 47 is used, only one 1 yen coin having the minimum diameter enters the groove 89 of the cam 87. Further, if the cam 87 is temporarily stopped in the middle of rotation, the coin can be reliably pushed into the groove 89 of the cam 87 by the pulling-over lever 47 and can be fed. Accordingly, the coin can be prevented from being bitten, and stably fed.

Figure 7:
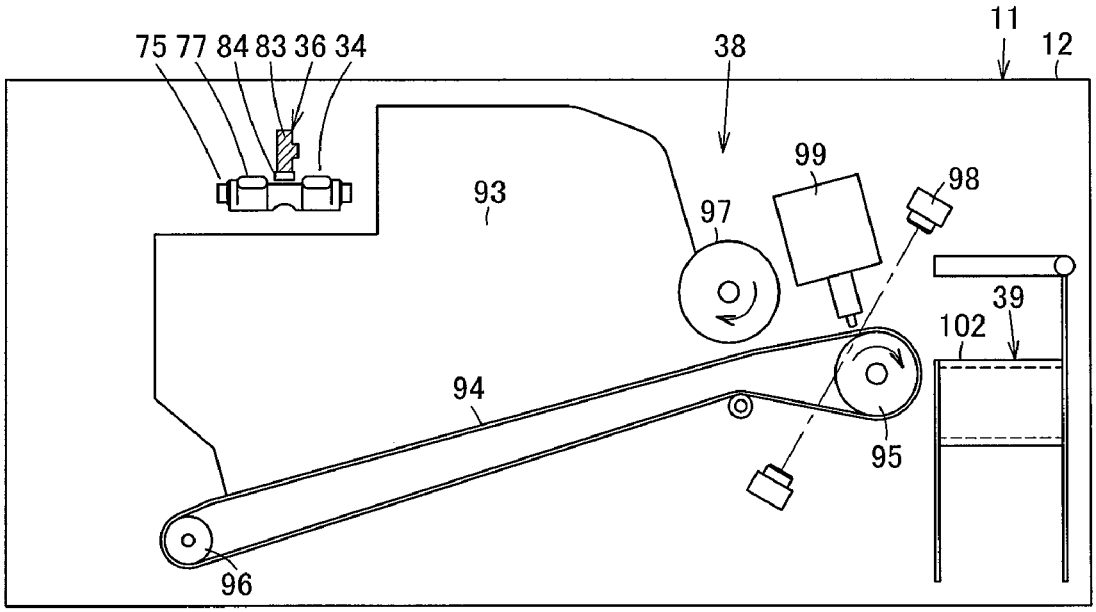
FIG. 7 is a cross sectional view of an accommodating and ejecting portion of the coin depositing and dispensing machine.

Additionally, the denomination-specific accommodating and ejecting portions 38 are set for 500 yen, 100 yen, 50 yen, 10 yen, 5 yen and 1 yen in this order from the front side of the machine body in accordance with denominations to be sorted by sorting portions 75 in the sorting passage 34. Further, as shown in FIG. 7, each accommodating and ejecting portion 38 has an accommodating portion 93 for accommodating the coins sorted and dropped in the sorting passage 34 without being aligned. An ejecting belt 94 constituting a bottom of the accommodating portion 93 is disposed along the machine body width direction.

The ejecting belt 94 is an endless flat belt and suspended so as to be tilted upward from the left side, upstream side in an ejecting direction, to the right side, downstream side, by a plurality of rollers containing both end rollers 95, 96 each pivotally supported on a horizontal shaft.

A reverse rotating roller 97 is provided across a gap, through which only one coin can pass, for the upper side of the end of the ejecting belt 94 in the coin ejecting direction. The reverse rotating roller 97 rotates in a direction opposite from the coin ejecting direction of the ejecting belt 94, and aligns non-aligned coins, which are to be ejected by rotation of the ejecting belt 94 in the coin ejecting direction, on the ejecting belt 94 by one layer and one line and ejects them.

Ejection detecting unit 98 and a stopper 99 are disposed on the end side, relative to the reverse rotating roller 97, of the ejecting belt 94 in the ejecting direction, the unit 98 for detecting the number of coins to be ejected from the end of the ejecting belt 94, the stopper 99 for forcibly stopping ejection of the succeeding coin at the time when coins are ejected by the necessary number of coins.

Additionally, as shown in FIGS. 1, 2 and 7, the transporting unit for dispensing 39 has a dispensing and transporting belt 102 which is stretched, in the longitudinal direction, aside of all the accommodating and ejecting portions 38 in the coin ejecting direction, and the coins ejected from each accommodating and ejecting portion 38 are placed on the dispensing and transporting belt 102 and transported forward. A reverse rotating roller 103 is provided across a gap, through which only one coin can pass, from the upper side of the front end of the dispensing and transporting belt 102 in the coin transporting direction. The reverse rotating roller 103 rotates in a direction opposite from the coin transporting direction of the dispensing and transporting belt 102, and aligns non-aligned coins on the dispensing and transporting belt 102 to be fed forward by rotation of the dispensing and transporting belt 102 by one layer and one line and feeds them.

A passage plate 104 is disposed between the front end of the dispensing and transporting belt 102 and the coin dispensing port 20, and a releasing belt 105 for transporting the coins fed by the dispensing and transporting belt 102 and releasing them into the coin dispensing port 20 is disposed above the passage plate 104.

Dispensing detecting unit 106 for detecting the number of coins to be dispensed into the coin dispensing port 20 is disposed in the transporting unit for dispensing 39.

Figure 8:
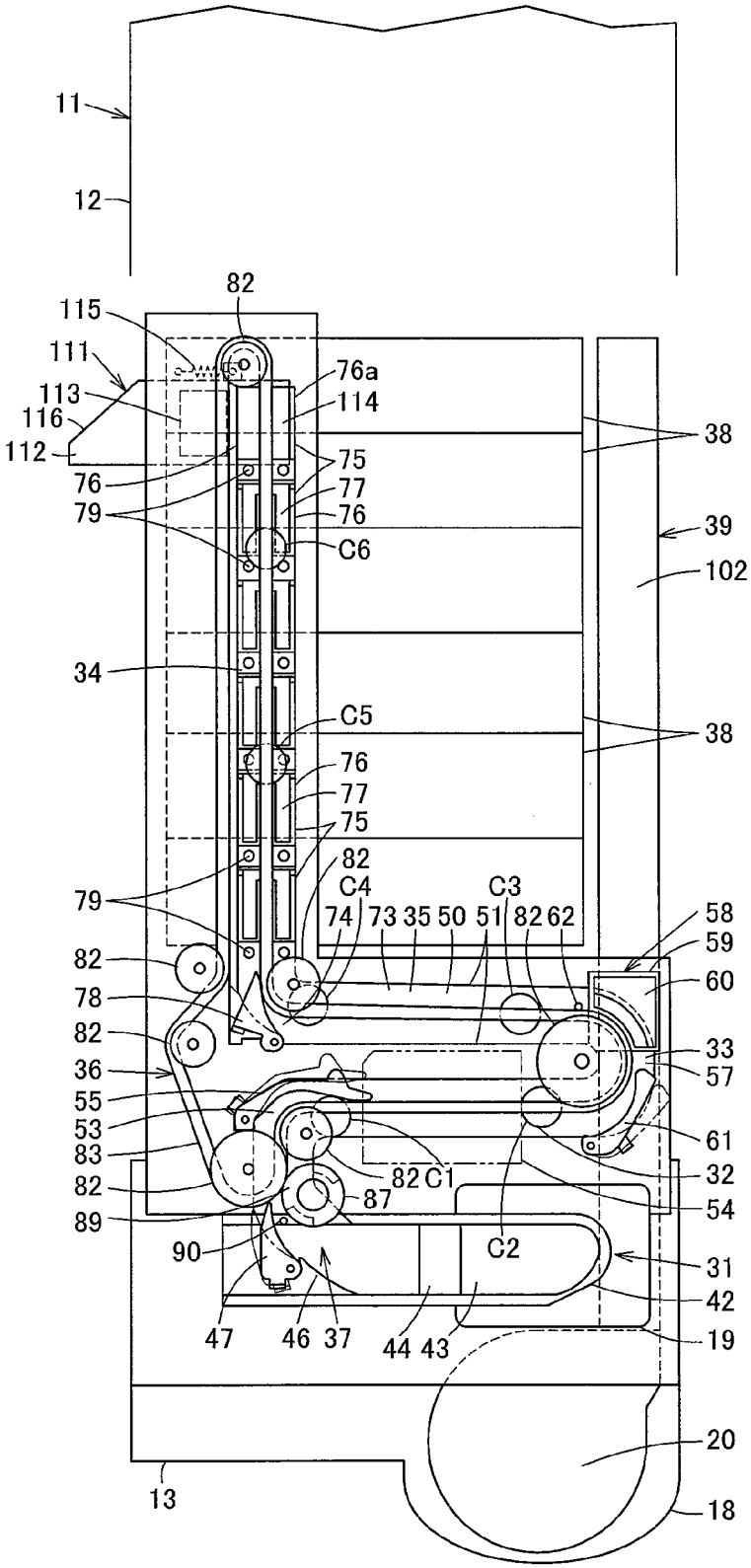
FIG. 8 is a plan view of a body unit pulled out from a machine body of the coin depositing and dispensing machine.

Additionally, as shown in FIGS. 1 and 8, a shutter mechanism 111 is provided at a position of the open sorting hole 76*a* at the most downstream side of the sorting passage 34 in the depositing and transporting direction, the shutter mechanism 111 for keeping the open sorting hole 76*a* in an open state when the depositing process is normally executed, and bringing it into a closed state of preventing coins from dropping into the open sorting hole 76*a* at least in the error-stop removing process during the depositing process.

The shutter mechanism 111 includes a shutter 112 slidably disposed in a direction of crossing over sorting passage 34 under the passage face 50, and in a direction of crossing over a direction of pulling out the body unit 13 forward from the machine body 12. In the shutter 112, an opening portion 113 for opening the open sorting hole 76*a* and a closing portion 114 for closing the open sorting hole 76*a* are juxtaposed in a sliding direction. An extension spring 115, as biasing unit for biasing the shutter 112 in a direction towards one side of the machine body 12, which is one of the reciprocal sliding directions of the shutter 112, is stretched in the shutter 112.

As shown in FIG. 1, in the case where the body unit 13 is accommodated in the machine body 12, the shutter 112 is located at a sorting hole open position for coming into contact with an inner wall of one side of the machine body 12 by a biasing force of the extension spring 115, and the opening portion 113 overlaps with the open sorting hole 76*a* at the sorting hole open position of the shutter 112 so that the open sorting hole 76*a* is open. Additionally, as shown in FIG. 8, in a state where the body unit 13 is pulled out from the machine body 12, the shutter 112 shifts to a sorting hole close position for projecting outward relative to the body unit 13 and one side of the machine body 12 by the biasing force of the extension spring 115, and is stopped by a stopper (not shown), and the closing portion 114 overlaps with the open sorting hole 76*a* at the sorting hole close position of the shutter 112 so that the open sorting hole 76*a* is closed.

A guide face 116 is formed in the shutter 112, the guide face 116 which, when the body unit 13 pulled out from the machine body 12 is accommodated in the machine body 12 again, comes into contact with the front end of one side of the machine body 12 and slides the shutter 112 from the sorting hole close position to the sorting hole open position so that the shutter 112 is accommodated in the machine body 12.

Additionally, control unit 121 for communicating with the POS cash register and controlling the coin depositing and dispensing machine 11 is disposed in the body unit 13.

The control unit 121 has a function of sorting control unit for specifying a position of the coin on the coin passage 35 based on the identification of the identifying portion 54 and the detections of coin detecting sensors 62, 79 and making the sorting portion 75 of the corresponding denomination sort the coin, and a function of accommodated coin numbers detecting unit for detecting the number of coins accommodated in each denomination-specific accommodating and ejecting portion 38, that is, balance detecting unit for detecting balance, based on the identification of the identifying portion 54 and the detections of coin detecting sensors 62, 79.

Additionally, the control unit 121 has a function of error-stopping unit for stopping depositing operation containing feeding operation by the feeding mechanism 31 and transporting operation by the transporting unit for depositing 36 in the case where a sorting error or the like is detected based on the detection of each coin detecting sensor 79 during the depositing operation of coins in the depositing process and a replenishment process, and a function of executing automatic restoration control for returning the coins remaining in the sorting passage 34 into the coin dispensing port 20 through the transporting unit for depositing 36, rejecting portion 58 and transporting unit for dispensing 39 in the case of the error-stop.

The control unit 121 further has a function of starting the automatic restoration control by reset of the error-stop with the reset button 15*a*, and a function of, after the automatic restoration control, handling the coins returned into the coin dispensing port 20 as rejected coins and making the depositing operation automatically restart.

Next, operation of the coin depositing and dispensing machine 11 of the present embodiment will be described.

First, the depositing process will be described.

Here, the rejection box 64 is not attached to the rejection box attaching portion 65, the rejected coins diverted from the rejecting portion 58 are received by the transporting unit for dispensing 39 and dispensed into the coin dispensing port 20.

Coins to be deposited are put into the feeding mechanism 31 through the coin input port 14, a coin detecting sensor (not shown) of the feeding mechanism 31 detects that the coins are put onto the feeding belt 43, and thus the feeding mechanism 31 is operated, the transporting belt 83 is rotated and the depositing operation is started.

In the feeding mechanism 31, the feeding belt 43 is rotated, the reverse rotating roller 44 is rotated in the reverse direction, and the non-aligned coins on the feeding belt 43 are aligned by one layer and one line to be fed to the delivering unit 37. In the delivering unit 37, by the above described operation of the pulling-over lever 47 and cam 87, the coins fed from the feeding mechanism 31 are fed into the identifying passage 32 one by one to be delivered to each projected portion 84 of the rotating transporting belt 83.

Additionally, in the identifying passage 32, the coins delivered by the delivering unit 37 are pushed and transported by the projected portions 84 of the transporting belt 83 to be identified by the identifying portion 54.

Coins, each of which is consequently identified as an appropriate coin, pass through the rejecting portion 58 of the eliminating passage 33 and are transported to the sorting passage 34. In the sorting passage 34, since a transporting position of the coin can be grasped based on the identification by the identifying portion 54, the detections by the coin detecting sensors 62, 79 and the transporting distance of the coin transported by the transporting belt 83, the coins, for each of which the denomination is identified by the identifying portion 54, are sorted by the corresponding denomination-specific sorting gate 77 and accommodated in the corresponding denomination-specific accommodating and ejecting portion 38.

Since the body unit 13 is here accommodated in the machine body 12 as shown in FIG. 1, the shutter 112 of the shutter mechanism 111 is in the sorting hole open position, the opening portion 113 overlaps with the open sorting hole 76*a*, and the open sorting hole 76*a* is in an open state. Therefore, coins transported to the open sorting hole 76*a*, 1 yen coins, are dropped and accommodated in the accommodating and ejecting portion 38 for 1 yen coins.

Additionally, the rejected coin, which is consequently identified as an unidentifiable coin or the like, is eliminated through the rejection hole 59 at the rejecting gate 60 when reaching the rejecting portion 58 of the eliminating passage 33.

At this time, in the case where the rejection box 64 is not attached, the rejected coins eliminated through the rejection hole 59 at the rejecting gate 60 directly drop onto the dispensing and transporting belt 102. Then, the dispensing and transporting belt 102 is rotated and the reverse rotating roller 103 is rotated in the reverse direction, and the rejected coins on the dispensing and transporting belt 102 are fed onto the passage plate 104 one by one and dispensed into the coin dispensing port 20 by the releasing belt 105. If no coin is detected by the feeding mechanism 31 and the identifying portion 54 for a predetermined time, the LED 22 of the light emitting unit 21 is turned on in red, and it is informed that the rejected coins are dispensed into the coin dispensing port 20.

Additionally, in the case where, during the depositing process, for example, a coin of a certain denomination cannot be diverted at the sorting gate 77 of the sorting portion 75 of the corresponding denomination, and are transported to the downstream side from the sorting portion 75 of the corresponding denomination in the depositing and transporting direction and detected by the coin detecting sensor 79 at the downstream side in the depositing and transporting direction, it is judged that there occurs a sorting error, and the depositing operation is immediately subjected to the error-stop.

Assuming that the error-stop state is a state shown in FIG. 1, coins C1, C2 remain in the identifying passage 32, and coins C3, C4, C5 and C6 remain in the sorting passage 34 (containing the connecting passage portion 73 and direction changing passage portion 74). Positions of the coins C1 to C6 on the passage are grasped based on detections by coin detecting sensors 62, 79 and 90.

The display portion 16 or the like displays the error-stop, an operator checking the display pushes down the reset button 15*a*, and thus the automatic restoration control is started.

In the automatic restoration control, first restoration control operation and second restoration control operation are alternately executed. First, in the first restoration control operation, the transporting belt 83 is rotated in the reverse transporting direction, the coins C1 to C6 on the passage are transported in the reverse transporting direction, and the rotation of the transporting belt 83 is stopped when the coin C3 located at the most upstream side of the sorting passage 34 is transported by a predetermined distance necessary for passage of the coin C3 through the rejecting portion 58 after the coin C3 is detected by the coin detecting sensor 62.

Then, in the second restoration control operation, the rejecting gate 60 of the rejecting portion 58 is opened, the transporting belt 83 is rotated in the depositing and transporting direction, the coins C1 to C6 on the passage are transported in the depositing and transporting direction, the rotation of the transporting belt 83 is stopped when the coin C3 is transported by a predetermined distance necessary for eliminating the coin C3 by the rejecting portion 58, and the rejecting gate 60 is closed.

Similarly, the first restoration control operation and the second restoration control operation are alternately carried out, the coins C4, C5 and C6 are successively eliminated from the rejecting portion 58 one by one.

The coins C3 to C6 successively eliminated from the rejecting portion 58 are dispensed into the coin dispensing port 20 by the dispensing and transporting belt 102 and the releasing belt 105 and returned as error return coins. Here, the number of the coins dispensed into the coin dispensing port 20 is counted by the dispensing detecting unit 106.

On the other hand, at the start of the automatic restoration control, before the transporting belt 83 is rotated in the reverse transporting direction, the cam 87 of the delivering unit 37 is rotated to a reverse constant position, where the coin C1 transported in the reverse transporting direction can be accepted into the groove 89, excitation of a motor for rotating the cam 87 is turned off, and a state of permitting rotation of the cam 87 is made.

By the first or n-th first restoration control operation, the coin C1 transported in the reverse transporting direction enters the groove 89 of the cam 87, pushes and rotates the cam 87 reversely, and the cam 87 is, when the coin detecting sensor 90 detects the coin C1, reversely rotated so that the coin C1 is forcibly returned to the feeding mechanism 31.

Similarly, by the n-th first restoration control operation, the coin C2 is returned to the feeding mechanism 31.

If no coin is detected by the coin detecting sensor 62 for a predetermined time even if the transporting belt 83 is rotated in the reverse transporting direction by the first restoration control operation, the transporting belt 83 is rotated in the depositing and transporting direction so that the presence/absence of a remaining coin is checked. If no remaining coin is detected, the transporting belt 83 is stopped, and the automatic restoration control is completed.

In the case where, after the automatic restoration control, the coins eliminated from the rejecting portion 58 have been counted as the number of coins accommodated in the denomination-specific accommodating and ejecting portion 38 by the identification of the identifying portion 54, the number of the coins eliminated from the rejecting portion 58 is subtracted from the number of accommodated coins of the corresponding denomination, that is, the coins returned into the coin dispensing port 20 are handled as rejected coins, when the number of the coins eliminated from the rejecting portion 58 corresponds to the number of coins detected by the dispensing detecting unit 106.

Additionally, in the case where some of coins returned to the feeding mechanism 31 have passed through the identifying portion 54 and have been counted as the number of coins accommodated in the denomination-specific accommodating and ejecting portion 38, the number of the coins returned to the feeding mechanism 31 again is subtracted from the number of accommodated coins of the corresponding denomination when the coin detecting sensor 90 detects that the coins, which have passed through the identifying portion 54, are returned to the feeding mechanism 31.

Additionally, also in the case where error return coins are dispensed into the coin dispensing port 20, the LED 22 of the light emitting unit 21 is turned on in red, and the operator is informed to that effect, similar to the case where rejected coins are dispensed. The operator takes out the coins returned into the coin dispensing port 20 and puts them into the coin input port 14 again.

After the automatic restoration control is completed, the depositing operation is automatically restarted.

Additionally, if the error-stop cannot be removed by the automatic restoration control, or if the error-stop is removed not by the automatic restoration control but by operation of the operator himself/herself, the body unit 13 is pulled out from the machine body 12, a space above the passage is opened up, and the coins C1 to C6 remaining on each passage are taken off, as shown in FIG. 8.

Here, the body unit 13 is pulled out from the machine body 12, and thus the shutter 112 of the shutter mechanism 111 shifts to the sorting hole close position by a biasing force of the extension spring 115 and the closing portion 114 closes the open sorting hole 76*a*. Accordingly, in the case where, for example, coins are located in a place being difficult to take out, and therefore the transporting belt 83 is manually rotated in the depositing and transporting direction so that the coins are shifted to a place being easy to take out, the coin C6 does not drop by the shutter 112 closing the open sorting hole 76*a* even if shifting to the open sorting hole 76*a*, and can be reliably taken out. Accordingly, the balance inconsistency of the coins in the accommodating and ejecting portion 38 can be prevented.

The body unit 13 is pushed and accommodated in the machine body 12 after the coins C1 to C6 on the passage are taken out, and thus the guide face 116 of the shutter 112 of the shutter mechanism 111 comes into contact with the front end of one side of the machine body 12, the shutter 112 shifts to the sorting hole open position while being accommodated in the machine body 12, the opening portion 113 overlaps with the open sorting hole 76*a*, and the open sorting hole 76*a* is brought into an open state.

The operator puts the coins C1 to C6 taken out from the passage into the coin input port 14 again. The body unit 13 is accommodated in the machine body 12, and thus the depositing process is restarted automatically, or by operation of the operating portion 15.

Next, a dispensing process will be described.

The ejecting belt 94 is rotated and the reverse rotating roller 97 is reversely rotated by, for example, a signal of dispensing command transmitted from the POS cash register, and the non-aligned coins on the ejecting belt 94 in each accommodating and ejecting portion 38 are aligned by one layer and one line and forwarded in the ejecting direction.

In the accommodating and ejecting portion 38 of denomination of coins to be dispensed, the stopper 99 is opened and the coins are ejected from the end of the ejecting belt 94 onto the dispensing and transporting belt 102 of the transporting unit for dispensing 39. The ejected coins are detected by the ejection detecting unit 98 to count the number of the coins.

In the accommodating and ejecting portion 38 of denomination of coins not to be dispensed and the accommodating and ejecting portion 38 of denomination of coins to be dispensed completing the ejecting necessary number of coins, the stoppers 99 are closed and the ejection of the coins is regulated.

Then, the dispensing and transporting belt 102 of the transporting unit for dispensing 39 is rotated and the reverse rotating roller 103 is rotated in the reverse direction, and coins to be paid on the dispensing and transporting belt 102 are fed onto the passage plate 104 one by one and dispensed into the coin dispensing port 20 by the releasing belt 105. An operation start of the transporting unit for dispensing 39 may be simultaneous with an ejecting operation start from the accommodating and ejecting portion 38, or after completion of the ejecting operation from all the accommodating and ejecting portions 38. The coins to be dispensed into the coin dispensing port 20 by the transporting unit for dispensing 39 are detected by the dispensing detecting unit 106 to count the number of the coins.

When the number of coins ejected which is detected by all the ejection detecting unit 98 corresponds to the number of coins to be dispensed which is detected by the dispensing detecting unit 106 and all the coins to be paid are dispensed into the coin dispensing port 20, the LED 22 of the light emitting unit 21 is turned on in green, and it is informed that the coins to be paid are dispensed into the coin dispensing port 20.

Next, a replenishment process will be described.

The replenishment process includes initial replenishment in the case where no coins are accommodated in the machine, and additional replenishment in the case where the coin quantity is reduced during operation. In the replenishment process, a large number of replenishment coins can be easily put into the machine by opening the cover 17 of the coin input port 14.

Additionally, in the replenishment process, similar to the depositing process, the replenishment coins put into the feeding mechanism 31 are fed to the identifying passage 32 one by one and identified by the identifying portion 54.

If the coins are each consequently identified as a normal replenishment coin, they are accommodated in denomination-specific accommodating and ejecting portions 38 by accommodating in accordance with denominations in the sorting passage 34 and replenish the portions 38. Additionally, if the fed coins are rejected coins, they are eliminated by the rejecting portion 58 and returned into the coin dispensing port 20 through the transporting unit for dispensing 39.

In the case where depositing operation of replenishment coins is error-stopped also in the replenishment process, the automatic restoration control is executed by the operation of the reset button 15*a*, the error-stop is automatically removed and the depositing operation of the replenishment coins is automatically restarted, similar to the case of the above described depositing process. Additionally, if the error-stop cannot be removed by the automatic restoration control, or if the error-stop is removed not by the automatic restoration control but by the operation of the operator himself/herself, the error-stop is removed by pulling out the body unit 13 from the machine boy 12 and taking off the coins on the passage, and then the body unit 13 is accommodated in the machine body 12 and the depositing operation of the replenishment coins is restarted, similar to the case of the above described depositing process.

Since the coins remaining in the sorting passage 34 can be thus returned into the coin dispensing port 20 through the transporting unit for depositing 36, the rejecting portion 58 and the transporting unit for dispensing 39 by the automatic restoration control in the case where the depositing operation is error-stopped in the depositing process and replenishment process, the coins remaining on the passage are not required to be manually taken off, the error-stop can be easily removed, and the removal mistake such that the operator drops the coins outward or into the accommodating and ejecting portion 38 when manually removing the error-stop can be prevented from causing the balance inconsistency.

Additionally, by instructing reset of error-stop with the reset button 15*a*, the automatic restoration control can be executed, and the automatic restoration can be realized by simple operation.

Additionally, after the automatic restoration control, the depositing operation can be automatically restarted, the coins returned into the coin dispensing port 20 are handled as rejected coins, and the balance inconsistency can be prevented.

Moreover, since the rejecting portion 58 has a structure capable of eliminating coins transported in the reverse transporting direction reverse to the depositing and transporting direction in addition to a structure capable of eliminating only coins transported in the depositing and transporting direction, the coins remaining in the sorting passage 34 can be eliminated from the rejecting portion 58 only by reverse rotation of the transporting belt 83 in the reverse transporting direction and the error-stop can be removed in a short time, at the time of the automatic restoration control.

Additionally, although the automatic restoration control is executed by the operation of the reset button 15*a*, it may be automatically executed when an error-stop occurs.

Additionally, the following features are provided in the present embodiment regarding prevention of the balance inconsistency of the coins in the accommodating portion (accommodating and ejecting portion 38) when the error-stop is manually removed.

In a conventional coin depositing and dispensing machine, coins put into a machine are fed to an identifying passage one by one, identified by an identifying portion, and coins identified as normal coins are transported to a sorting passage, sorted for each denomination, and accommodated in denomination-specific accommodating portions, in a depositing process. A transporting belt for transporting coins is disposed above the identifying passage and sorting passage. Additionally, denomination-specific sorting holes for sorting coins for each denomination are formed in the sorting passage. For example, in the case where coins are sorted with reference to the outer diameters of the coins, denomination-specific sorting holes are formed in an open state, the holes for first dropping a coin having a small diameter and successively dropping a coin having a larger diameter (see, for example, Japanese Patent No. 3867748). Additionally, regarding the denomination-specific accommodating portions, balances of coins sorted in the sorting passage and accommodated in the accommodating portions are managed based on identification of the identifying portion and detections of coin detecting sensors disposed on the passage.

During the depositing process, in the case where there occurs an error in a transporting system, transport of coins is stopped and waits for error-stop removal. In the case where there occurs such an error-stop, the coins being transported remain on the passage and error-stop removal for taking off the coins is required. When the error-stop is removed, a body unit is opened so that the passage is opened up. Thus, the coins remaining on the passage are taken off. At this time, some of the coins are difficult to be taken off depending on positions thereof, and therefore the coins are sometimes shifted, by manually rotating the transporting belt, to a place being easy to take out and taken out.

However, in the case where there are provided open sorting holes in the sorting passage, coins sometimes drop into the open sorting holes by manual rotation of the transporting belt, and data of the balance of coins in the accommodating portion becomes inconsistent with the real balance.

Thereupon, it is an object of the present invention to prevent coins from erroneously dropping through the sorting holes at least in an error-stop removing process during the depositing process, and prevent the balance inconsistency of the coins in the accommodating portion.

In order to achieve the object, there is provided a coin depositing and dispensing machine (coin depositing and dispensing machine 11) including: the feeding mechanism 31 for feeding coins put into the coin input port 14 one by one; the identifying passage 32 having the identifying portion 54 for identifying the coins fed from the feeding mechanism 31; the sorting passage 34 which is disposed continuously to the identifying passage 32 and has the plurality of sorting holes 76 for sorting the coins for each denomination; the transporting unit for depositing 36 for transporting the coins through the identifying passage 32 and the sorting passage 34; and a plurality of accommodating portions (accommodating and ejecting portions 38) which is disposed under the sorting passage 34, accommodate the coins sorted for each denomination by the sorting passage therein, wherein the shutter mechanism 111 is provided, the mechanism 111 for keeping, among the sorting holes 76, at least the opened sorting hole 76 in an open state when the depositing process is normally executed, and bringing, at least in the error-stop removing process during the depositing process, the opened sorting hole 76 into a closed state for preventing the coins from dropping into the sorting hole 76. The shutter mechanism 111 thus keeps the sorting hole 76 in an open state when the depositing process is normally executed, however, brings, at least in the error-stop removing process during the depositing process, the opened sorting hole 76 into a closed state for preventing the coins from dropping into the sorting hole 76, and thus the coins do not erroneously drop through the sorting hole 76, and the balance inconsistency of the coins in the accommodating portion (accommodating and ejecting portion 38) can be prevented.

Additionally, there are provided the machine body 12 and the body unit 13, which can be released or pulled out from the machine body 12 and has the feeding mechanism 31, the identifying passage 32, the sorting passage 34, the transporting unit for depositing 36 and the accommodating portions (accommodating and ejecting portions 38), and the shutter mechanism 111 closes the sorting hole 76 in conjunction with the release or pulling-out of the body unit 13. Since, as described above, the shutter mechanism 111 automatically closes the sorting hole 76 in conjunction with the release or pulling-out of the body unit 13, special operation is unnecessary and the coins can be reliably prevented from erroneously dropping through the sorting hole 76.

Additionally, the sorting hole 76 located at a last position in the coin transporting direction among the plurality of sorting holes 76 of the sorting passage 34 is in an open state, and the shutter mechanism 111 is provided at the sorting hole 76 of the last position. Since, as described above, the shutter mechanism 111 is provided at the sorting hole 76 of the last position even if the sorting hole 76 located at the last position in the coin transporting direction among the plurality of sorting holes 76 of the sorting passage 34 is in an open state, the coins can be prevented from erroneously dropping through the sorting hole 76 in the error-stop removing process.

Moreover, although the case is described above where the sorting hole 76 located at the last position in the coin transporting direction among the plurality of sorting holes 76 of the sorting passage 34 is in an open state, also in the case where some or all of the sorting holes 76 are in an open state, the shutter mechanism 111 can be applied to the opened sorting holes 76 to prevent coins from dropping when the error-stop is removed.

Additionally, the shutter mechanism 111 is applicable not only to the coin depositing and dispensing machine 11 enabling depositing and dispensing of coins, but also a coin depositing machine exclusively for depositing.

The invention claimed is:

1. A coin depositing and dispensing machine comprising:

a feeding mechanism for feeding coins put into a coin input port one by one;

an identifying passage having an identifying portion for identifying the coins fed from the feeding mechanism;

an eliminating passage which is disposed continuously to the identifying passage and has a rejecting portion for discharging coins identified as rejected coins by the identifying portion;

a sorting passage which is disposed continuously to the eliminating passage and sorts coins;

transporting unit for depositing capable of transporting coins in a depositing and transporting direction of transporting the coins through the identifying passage, eliminating passage and sorting passage in this order, and in a reverse transporting direction reverse to the depositing and transporting direction;

denomination-specific accommodating and ejecting portions which are disposed under the sorting passage, accommodate the coins sorted for each denomination by the sorting passage therein and can eject the accommodated coins;

a transporting unit for dispensing for transporting the coins ejected from the accommodating and ejecting portions into a coin dispensing port; and a control unit for executing automatic restoration control for transporting coins remaining in the sorting passage by the transporting unit for depositing in a reverse transporting direction and returning them into the coin dispensing port by the rejecting portion and transporting unit for dispensing in the case where an error-stop occurs during depositing operation.

2. The coin depositing and dispensing machine according to claim 1, further comprising resetting unit for instructing reset of the error-stop, wherein the control unit executes automatic restoration control by reset of the error-stop by the resetting unit.

3. The coin depositing and dispensing machine according to claim 1, wherein the control unit, after automatic restoration control, handles coins returned into the coin dispensing port as rejected coins, and makes depositing operation automatically restart.

4. The coin depositing and dispensing machine according to claim 1, wherein the rejecting portion can discharge coins transported by the transporting unit for depositing in a depositing and transporting direction and a reverse transporting direction, and the control unit, at the time of the automatic restoration control, makes the rejecting portion eliminate coins only by reverse rotation of the transporting unit for depositing in the reverse transporting direction.

* * * * *